US006973424B1

(12) United States Patent
Ozawa

(10) Patent No.: US 6,973,424 B1
(45) Date of Patent: Dec. 6, 2005

(54) VOICE CODER

(75) Inventor: Kazunori Ozawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/720,767

(22) PCT Filed: Jun. 29, 1999

(86) PCT No.: PCT/JP99/03492

§ 371 (c)(1),
(2), (4) Date: Dec. 29, 2000

(87) PCT Pub. No.: WO00/00963

PCT Pub. Date: Jan. 6, 2000

(30) Foreign Application Priority Data

Jun. 30, 1998 (JP) ..... 10/185179

(51) Int. Cl.[7] ..... G10L 19/00; G10L 19/10; G10L 19/12

(52) U.S. Cl. ..... 704/219; 704/205; 704/223; 704/229; 704/230

(58) Field of Search ..... 704/205, 207, 704/216, 219, 222, 223, 228, 229, 230

(56) References Cited

U.S. PATENT DOCUMENTS

| | | | | |
|---|---|---|---|---|
| 4,220,819 | A * | 9/1980 | Atal | 704/219 |
| 6,148,282 | A * | 11/2000 | Paksoy et al. | 704/219 |
| 2002/0029140 | A1 | 3/2002 | Ozawa | |

FOREIGN PATENT DOCUMENTS

| | | | |
|---|---|---|---|
| JP | 4-171500 | 6/1992 | |
| JP | 4-363000 | 12/1992 | |
| JP | 5-6199 | 1/1993 | |
| JP | 5-281999 | 10/1993 | |
| JP | 6-222797 | 8/1994 | |
| JP | 06-222797 | * 12/1994 | ..... G10L 9/14 |
| JP | 9-146599 | 6/1997 | |
| JP | 9-179593 | 7/1997 | |
| JP | 10-124091 | 5/1998 | |
| JP | 10-133696 | 5/1998 | |

OTHER PUBLICATIONS

M. Schroeder and B. Atal, "Code-excited linear prediction: High quality speech at very low bit rates" (Proc. ICASSP, pp. 937-940, 1985.

Kleijn et al., "Improved speech quality and efficient vector quantization in CEL'P" (Proc. ICASSP :pp. 155-158, 1988.

Laflamme et al., "16kbps wideband speech coding technique based on algebraic CELP"(Proc. ICASSP, pp. 13-16, 1991.

"Signal Analysis and System Identification" written by Nakamizo (published in 1998, Corona), pp. 82-87.

(Continued)

*Primary Examiner*—Richemond Dorvil
*Assistant Examiner*—V. Paul Harper
(74) *Attorney, Agent, or Firm*—Dickstein, Shapiro, Morin & Oshinsky, LLP.

(57) ABSTRACT

A speech coder capable of achieving an excellent sound quality even at a low bit rate. A mode judging circuit 800 of the speech coder judges a mode by the use of a feature quantity of an input speech signal for each subframe. In case of a predetermined mode, an excitation quantization circuit 350 searches combinations of every code vectors stored in codebooks 351 and 352 for simultaneously quantizing amplitudes or polarities of a plurality of pulses and each of a plurality of shift amounts for temporally shifting predetermined pulse positions, and selects a combination of the code vector and the shift amount which minimizes distortion from an input speech. A gain quantization circuit 365 quantizes a gain by the use of a gain codebook 380.

9 Claims, 5 Drawing Sheets

OTHER PUBLICATIONS

Sugamura et al. "Speech Data Compression by Linear Spectral Pair (LSP) Speech Analysis-Synthesis Technique" (Journal of the electronic Communications Society of Japan, J64-A, pp. 599-606, 1981.

T. Nomura et al. "LSP Coding Using VQ-SVQ With Interpolation in 4.075 kbps M-LCELP Speech Coder" (Proc. Mobile Mulitmedia Communications, pp. B2.5, 1993.

P. Kroon et al., "Pitch predictors with high temporal resolution" (Proc. ICASSP, pp. 661-664, 1990.

Linde et al. "An algorithm for vector quantization design" (IEEE Trans. Commun., pp. 84-95, Jan., 1980).

Copy of Japanese Office Action dated Aug. 27, 2003 (and English translation of relevant portion).

Oshikiri et al., "CELP Coding with Individual Adaptive Codebooks for Voiced and Unvoiced Frame", 1994 Fall Meeting of the Electronic Information Communication Conference, Toshiba Research and Development Center, p. A-180 (1994).

* cited by examiner

VOICE CODER

TECHNICAL FIELD

This invention relates to a speech coder and, in particular, to a speech coder for coding a speech signal with a high quality at a low bit rate.

BACKGROUND ART

As a system for coding a speech signal at a high efficiency, CELP (Code Excited Linear Predictive Coding) is known in the art. For example, the CELP is described in M. Schroeder and B. Atal, "Code-excited linear prediction: High quality speech at very low bit rates" (Proc. ICASSP, pp. 937–940, 1985: hereinafter referred to as Reference 1), Kleijn et al, "Improved speech quality and efficient vector quantization in CELP" (Proc. ICASSP, pp. 155–158, 1988: hereinafter referred to as Reference 2), and so on.

In the above-mentioned CELP coding system, on a transmission side, spectral parameters representative of spectral characteristics of a speech signal are at first extracted from the speech signal for each frame (for example, 20 ms long) by the use of a linear predictive (LPC) analysis. Then, each frame is divided into subframes (for example, 5 ms long). For each subframe, parameters (a gain parameter and a delay parameter corresponding to a pitch period) in an adaptive codebook are extracted on the basis of a preceding excitation signal. By the use of an adaptive codebook, the speech signal of the subframe is pitch-predicted.

For an excitation signal obtained by the pitch prediction, an optimum excitation code vector is selected from an excitation codebook (vector quantization codebook) including predetermined kinds of noise signals and an optimum gain is calculated. Thus, a quantized excitation signal is obtained.

The selection of the excitation code vector is carried out so that an error power between a signal synthesized by the selected noise signal and the above-mentioned residual signal is minimized. An index representative of the kind of the selected code vector, the gain, the spectral parameters, and the parameters of the adaptive codebook are combined by a multiplexer unit and transmitted. Description of a reception side is omitted herein.

In the above-mentioned conventional coding system, however, two major problems arise.

One of the problems is that a large amount of calculation is required to select the optimum excitation code vector from the excitation codebook. This is because, in the methods described in Reference 1 and Reference 2 mentioned above, each code vector is subjected to filtering or a convolution operation and this operation is repeated multiple times equal in number to code vectors stored in the codebook, in order to select the excitation code vector. For example, in case where the codebook has B bits and N dimensions, let the filter length or the impulse response length upon the filtering or the convolution operation be represented by K. Then, the amount of calculation of $N \times K \times 2B \times 8000/N$ is required per second. By way of example, consideration will be made about the case where B=10, N=40, and k=10. In this event, it is necessary to execute the operation 81,920,000 times per second. Thus, it will be understood that the amount of calculation is enormously large.

In order to reduce the amount of calculation required to search the excitation codebook, various methods have been proposed in the art. For example, an ACELP (Algebraic Code Excited Linear Prediction) system is proposed. This system is described, for example, in C. Laflamme et al, "16 kbps wideband speech coding technique based on algebraic CELP" (Proc. ICASSP, pp. 13–16, 1991: hereinafter referred to as Reference 3).

In the method described in Reference 3 mentioned above, an excitation signal is expressed by a plurality of pulses and, furthermore, positions of the pulses each represented by a predetermined number of bits are transmitted. Herein, the amplitude of each pulse is restricted to +1.0 or −1.0. Therefore, in the method described in Reference 3, the amount of calculation required to search the pulses can considerably be reduced.

The other problem is that an excellent sound quality is obtained at a bit rate of 8 kb/s or more but, particularly when a background noise is superposed on a speech, the sound quality of a background noise part of a coded speech is significantly deteriorated at a lower bit rate.

The reason is as follows. The excitation signal is expressed by a combination of a plurality of pulses. Therefore, in a vowel period of the speech, the pulses are concentrated around a pitch pulse which gives a starting point of a pitch. In this event, the speech signal can be efficiently represented by a small number of pulses. On the other hand, with respect to a random signal such as the background noise, non-concentrated pulses must be produced. In this event, it is difficult to appropriately represent the background noise with a small number of pulses. Therefore, if the bit rate is lowered and the number of pulses is decreased, the sound quality for the background noise is drastically deteriorated.

It is therefore an object of this invention to remove the above-mentioned problems and to provide a speech coder which requires a relatively small amount of calculation but is suppressed in deterioration of the sound quality for a background noise even if a bit rate is low.

DISCLOSURE OF THE INVENTION

In order to achieve the above-mentioned object, a speech coder according to a first aspect of this invention comprises: a spectral parameter calculating unit supplied with a speech signal for calculating and quantizing spectral parameters; an adaptive codebook unit for calculating a delay and a gain from a preceding quantized excitation signal by the use of an adaptive codebook, predicting the speech signal, and calculating a residue; and an excitation quantizing unit for quantizing an excitation signal of said speech signal by the use of said spectral parameters to produce an output; said speech coder further comprising: a judging unit for extracting a feature from said speech signal to judge a mode; a codebook for representing the excitation signal by a combination of a plurality of nonzero pulses and simultaneously quantizing amplitudes or polarities of said pulses in case where the output of said judging unit is a predetermined mode; said excitation quantizing unit for searching combinations of code vectors stored in said codebook and a plurality of shift amounts for shifting pulse positions of said pulses and producing as an output a combination of the code vector and the shift amount, the produced combination minimizing distortion from an input speech; and a multiplexer unit for producing a combination of the output of said spectral parameter calculating unit, the output of said judging unit, the output of said adaptive codebook unit, and the output of said excitation quantizing unit.

According to a second aspect of this invention, the speech coder comprises: a spectral parameter calculating unit supplied with a speech signal for calculating and quantizing spectral parameters; an adaptive codebook unit for calculating a delay and a gain from a preceding quantized excitation signal by the use of an adaptive codebook, predicting a speech signal, and calculating a residue; and an excitation quantizing unit for quantizing an excitation signal of said speech signal by the use of said spectral parameters to produce an output; said speech coder further comprising: a judging unit for extracting a feature from said speech signal to judge a mode; a codebook for representing the excitation signal by a combination of a plurality of nonzero pulses and simultaneously quantizing amplitudes or polarities of said pulses in case where the output of said judging unit is a predetermined mode; said excitation quantizing unit for generating pulse positions of said pulses in accordance with a predetermined rule and producing a code vector which minimizes distortion from the input speech; and a multiplexer unit for producing a combination of the output of said spectral parameter calculating unit, the output of said judging unit, the output of said adaptive codebook unit, and the output of said excitation quantizing unit.

According to a third aspect of this invention, the speech coder comprises: a spectral parameter calculating unit supplied with a speech signal for calculating and quantizing spectral parameters; an adaptive codebook unit for calculating a delay and a gain from a preceding quantized excitation signal by the use of an adaptive codebook, predicting a speech signal, and calculating a residue; and an excitation quantizing unit for quantizing an excitation signal of said speech signal by the use of said spectral parameters to produce an output; said speech coder comprising: a judging unit for extracting a feature from said speech signal to judge a mode; a codebook for representing the excitation signal by a combination of a plurality of nonzero pulses and simultaneously quantizing amplitudes or polarities of said pulses in case where the output of said judging unit is a predetermined mode and a gain codebook for quantizing the gain; said excitation quantizing unit for searching combinations of code vectors stored in said codebook, a plurality of shift amounts for shifting pulse positions of said pulses, and gain code vectors stored in said gain codebook, and producing as an output a combination of the code vector, the shift amount, and the gain code vector, the produced combination minimizing distortion from an input speech; and a multiplexer unit for producing a combination of the output of said spectral parameter calculating unit, the output of said judging unit, the output of said adaptive codebook unit, and the output of said excitation quantizing unit.

According to a fourth aspect of this invention, the speech coder comprises: a judging unit for extracting a feature from said speech signal to judge a mode; a codebook for representing the excitation signal by a combination of a plurality of nonzero pulses and simultaneously quantizing amplitudes or polarities of said pulses in case where the output of said judging unit is a predetermined mode and a gain codebook for quantizing the gain; said excitation quantizing unit for generating pulse positions of said pulses in accordance with a predetermined rule and producing a combination of the code vector and the gain code vector, the combination minimizing distortion from the input speech; and a multiplexer unit for producing a combination of the output of said spectral parameter calculating unit, the output of said judging unit, the output of said adaptive codebook unit, and the output of said excitation quantizing unit.

BEST MODE FOR EMBODYING THE INVENTION

Figure 1:
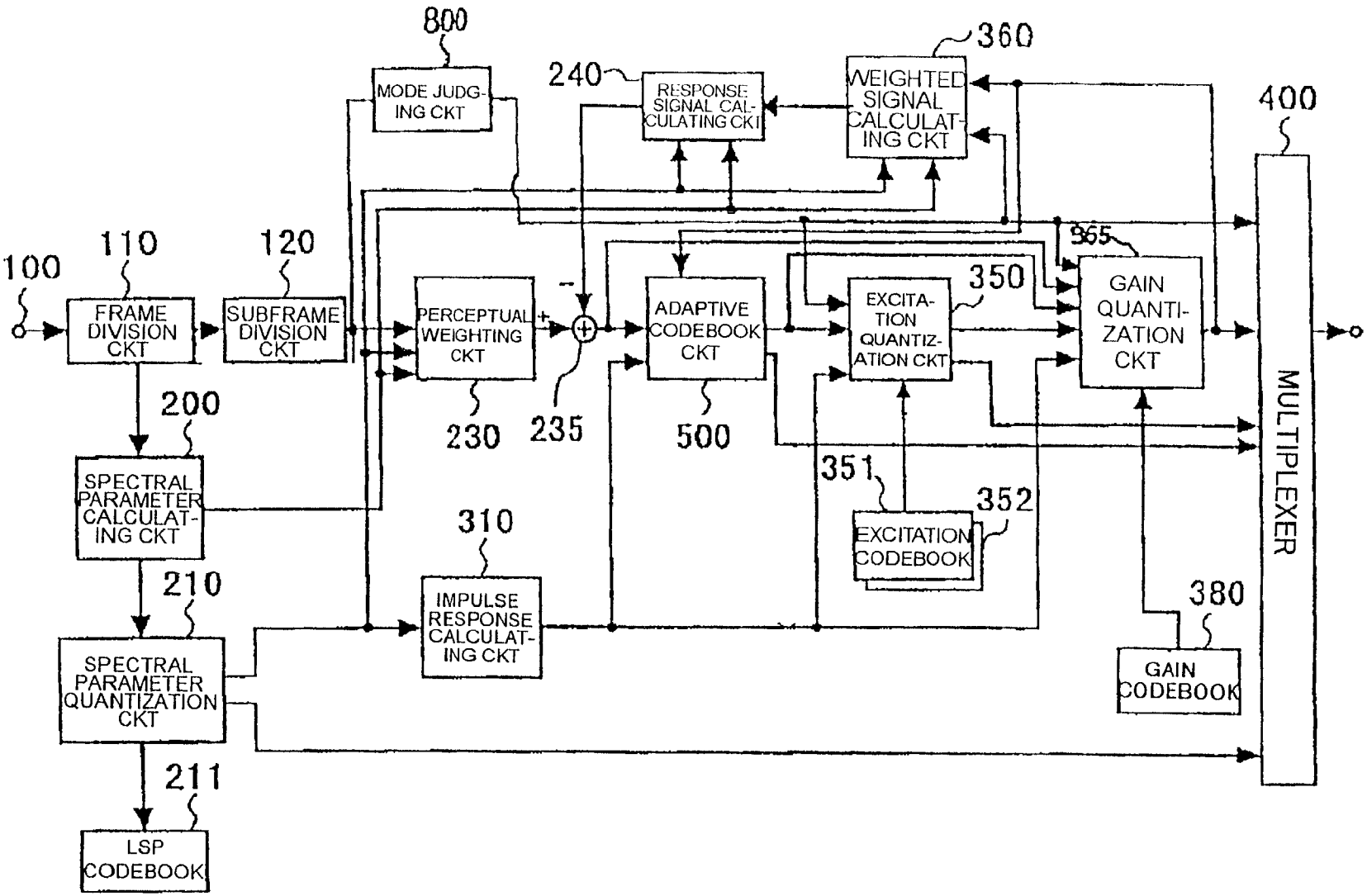
FIG. 1 is a block diagram showing the structure of a first embodiment of this invention.

Now, description will be made of a mode for embodying this invention.

In a speech coder according to one mode for embodying this invention, a mode judging circuit (800 in FIG. 1) extracts a feature quantity from a speech signal and judges a mode on the basis of the feature quantity. When the mode thus judged is a predetermined mode, an excitation quantization circuit (350 in FIG. 1) searches combinations of every code vectors stored in codebooks (351, 352) for simultaneously quantizing amplitudes or polarities of a plurality of pulses, and each of a plurality of shift amounts for temporally shifting predetermined pulse positions of the pulses, and selects a combination of the code vector and the shift amount which minimizes distortion from the input speech. A gain quantization circuit (365 in FIG. 1) quantizes a gain by the use of a gain codebook (380 in FIG. 1). A multiplexer unit (400 in FIG. 1) produces a combination of the output of a spectral parameter calculating unit (210 in FIG. 1), the output of the mode judging unit (800 in FIG. 1), the output of an adaptive codebook circuit (500 in FIG. 1), the output of the excitation quantization unit (350 in FIG. 1), and the output of the gain quantization circuit.

In a speech decoder according to a preferred mode for embodying the invention, a demultiplexer unit 510 demultiplexes a code sequence supplied through an input terminal into codes representative of spectral parameters, delays of the adaptive codebook, adaptive code vectors, excitation gains, amplitudes or polarity code vectors as excitation information, and pulse positions and outputs these codes. A mode judging unit (530 in FIG. 5) judges a mode by the use of a preceding quantized gain in an adaptive codebook. An excitation signal restoring unit (540 in FIG. 5) produces nonzero pulses from quantized excitation information to restore an excitation signal in case where the output of the mode judging unit is a predetermined mode. In the above-mentioned speech decoder, the excitation signal is made to pass through a synthesis filter unit (560 in FIG. 5) to produce a reproduced speech signal.

Now, description will be made of embodiments of this invention with reference to the drawings.

Referring to FIG. 1, when a speech signal is supplied through an input terminal 100, a frame division circuit 110 divides the speech signal into frames (for example, 20 m long). A subframe division circuit 120 divides the frame signals of the speech signal into subframes (for example, 5 ms long) shorter than the frames.

A spectral parameter calculating circuit 200 applies another frame (for example, 24 ms long) longer than the subframe length to at least one subframe of the speech signal to extract a speech, thereby calculating spectral parameters with a predetermined degree (for example, P=10). For the calculation of the spectral parameters, the well-known LPC (Linear Predictive Coding) analysis, the Burg analysis, and so forth may be used. In this embodiment, the Burg analysis is adopted. For the details of the Burg analysis, reference will be made to the description in "Signal Analysis and System Identification" written by Nakamizo (published in 1998, Corona), pages 82–87 (hereinafter referred to as Reference 4). The description of Reference 4 is incorporated herein by reference.

In addition, the spectral parameter calculating unit 210 converts linear prediction coefficients $\alpha_i$ (i=1, . . . , 10) calculated by the Burg analysis into LSP parameters suitable for quantization and interpolation. For the conversion from the linear prediction coefficients into the LSP parameters, reference may be made to Sugamura et al, "Speech Data Compression by Linear Spectral Pair (LSP) Speech Analysis-Synthesis Technique" (Journal of the Electronic Communications Society of Japan, J64-A, pp. 599–606, 1981: hereinafter referred to as Reference 5). For example, the linear prediction coefficients calculated by the Burg analysis for second and fourth subframes are converted into the LSP parameters. The LSP parameters of first and third subframes are calculated by linear interpolation. The LSP parameters of the first and the third subframes are inverse-converted into the linear prediction coefficients. The linear prediction coefficients $\alpha_{il}$ (i=1, . . . , 10, l=1, . . . , 5) of the first through the fourth subframes are delivered to a perceptual weighting circuit 230. The LSP parameter of the fourth subframe is delivered to the spectral parameter quantization circuit 210.

The spectral parameter quantization circuit 210 efficiently quantizes a LSP parameter of a predetermined subframe to produce a quantization value which minimizes the distortion given by the following equation (1).

$$D_j = \sum_{i=1}^{10} W(i)[LSP(i) - QLSP(i)_j]^2 \tag{1}$$

where LSP(i), $QLSP(i)_j$, W(i) represent an i-th order LSP coefficient before quantization, a j-th result after quantization, and a weighting factor, respectively.

In the following description, vector quantization is used as a quantization method and the LSP parameter of the fourth subframe is quantized. For the vector quantization of the LSP parameters, known techniques may be used. For example, the details of the techniques are disclosed in Japanese Unexamined Patent Publication (JP-A) No. H04-171500 (Japanese Patent Application No. H02-297600: hereinafter referred to as Reference 6), Japanese Unexamined Patent Publication (JP-A) No. H04-363000 (Japanese Patent Application No. H03-261925: hereinafter referred to as Reference 7), Japanese Unexamined Patent Publication (JP-A) No. H05-6199 (Japanese Patent Application No. H03-155049: hereinafter referred to as Reference 8), and T. Nomura et al, "LSP Coding Using VQ-SVQ With Interpolation in 4.075 kbps M-LCELP Speech Coder" (Proc. Mobile Multimedia Communications, pp. B.2.5, 1993: hereinafter referred to as Reference 9). The contents described in these references are incorporated herein by reference.

Based on the LSP parameter quantized in accordance with the fourth subframe, the spectral parameter quantization circuit 210 restores the LSP parameters of the first through the fourth subframes. Herein, the spectral parameter quantization circuit 210 restores the LSP parameters of the first through the third subframes by linear interpolation of the quantized LSP parameter of the fourth subframe of a current frame and the quantized LSP parameter of the fourth subframe of a preceding frame immediately before. Herein, the spectral parameter quantization circuit 210 can restore the LSP parameters of the first through the fourth subframes by selecting one kind of the code vectors which minimizes the error power between the LSP parameters before quantization and the LSP parameters after quantization and thereafter carrying out linear interpolation. In order to further improve the performance, the spectral parameter quantization circuit 210 may select a plurality of candidate code vectors which minimize the error power, evaluate cumulative distortion for each of the candidates, and select a set of the candidate and the interpolated LSP parameter which minimizes the cumulative distortion. The details of the related technique are disclosed, for example, in the specification of Japanese Patent Application No. H05-8737 (hereinafter referred to as Reference 10). The content described in Reference 10 is incorporated herein by reference.

The spectral parameter quantization circuit 210 converts the LSP parameters of the first through the third subframes restored in the manner mentioned above and the quantized LSP parameters of the fourth subframe into the linear prediction coefficients α il (i=1, . . . , 10, l=1, . . . 5) for each subframe, and outputs the linear prediction coefficients into an impulse response calculating circuit 310. In addition, the spectral parameter quantization circuit 210 supplies the multiplexer 400 with an index indicating the code vector of the quantized LSP parameter of the fourth subframe.

Supplied from the spectral parameter calculating circuit 200 with the linear prediction coefficients $\alpha_{il}$(i=1, . . . , 10, l=1, . . . , 5) before quantization for each subframe, the perceptual weighting circuit 230 carries out perceptual weighting upon the speech signal of the subframe to produce a perceptual weighted signal in accordance with Reference 1 mentioned above.

Supplied from the spectral parameter calculating circuit 200 with the linear prediction coefficients $\alpha_{il}$ for each subframe and supplied from the spectral parameter quantization circuit 210 with the restored linear prediction coefficients $\alpha_{il}$ obtained by quantization and interpolation for each subframe, a response signal calculating circuit 240 calculates a response signal for one subframe with an input signal assumed to be zero, d(n)=0, by the use of a value of a filter memory being reserved, and delivers the response signal to a subtractor 235. The response signal $x_Z(n)$ is expressed by the following equation:

$$x_z(n) = d(n) - \sum_{i=1}^{10} \alpha_i d(n-i) + \sum_{i=1}^{10} \alpha_i \gamma^i y(n-i) + \sum_{i=1}^{10} \alpha_i' \gamma^i x_x(n-i) \tag{2}$$

When n−i≦0:

$$y(n-i)=p(N+(n-i)) \tag{3}$$

$$x_z(n-i)=s_x(N+(n-i)) \tag{4}$$

Herein, N represents the subframe length. γ represents a weighting factor for controlling a perceptual weight and equal to the value in the equation (7) which will be given below. $s_w(n)$ and p(n) represent an output signal of a weighted signal calculating circuit and an output signal corresponding to a denominator of a filter in a first term of the right side in the equation (7) which will later be described, respectively.

The subtractor 235 subtracts the response signal for one subframe from the perceptual weighted signal in accordance with the following equation (5), and delivers $x'_w(n)$ to an adaptive codebook circuit 300.

$$x'_w(n)=x_w(n)-x_x(n) \tag{5}$$

An impulse response calculating circuit 310 calculates a predetermined number L of impulse responses $h_W(n)$ of a perceptual weighting filter whose z transform is a transfer function $H_w(z)$ expressed by the following equation (6), and delivers the impulse responses to the adaptive codebook circuit 500 and the excitation quantization circuit 350.

$$H_w(Z)=\frac{1-\sum_{i=1}^{10}\alpha_i Z^{-1}}{1-\sum_{i=1}^{10}\alpha_i\gamma^i Z^{-i}}\cdot\frac{1}{1-\sum_{i=1}^{10}\alpha'_i\gamma^i Z^{-i}} \tag{6}$$

The mode judging circuit 800 extracts a feature quantity from the output signals of the subframe division circuit 120 to judge utterance or silence for each subframe. Herein, as the feature, a pitch prediction gain may be used. The mode judging circuit 800 compares the pitch prediction gain calculated for each subframe and a predetermined threshold value and judges the utterance and the silence when the pitch prediction gain is greater than the threshold value and is not, respectively.

The mode judging circuit 800 delivers utterance/silence judgment information to the excitation quantization circuit 350, the gain quantization circuit 365, and the multiplexer 400.

The adaptive codebook circuit 500 is supplied with a preceding excitation signal from the gain quantization circuit 365, the output signal $x'_w(n)$ from the subtractor 235, and the perceptual weighted impulse response $h_w(n)$ from the impulse response calculating circuit 310. Supplied with these signals, the adaptive codebook circuit 500 calculates a delay T corresponding to a pitch so that distortion $D_T$ in the following equation (7) is minimized, and delivers an index representative of the delay to the multiplexer 400.

$$D_T=\sum_{n=0}^{N-1}x_w'^2(n)-\left[\sum_{n-}^{N-1}x'_w(n)y_w(n-T)\right]^2\Big/\left[\sum_{n=0}^{N-1}y_w^2(n-T)\right] \tag{7}$$

$$y_w(n-T)=v(n-T)*h_w(n) \tag{8}$$

In the equation (8), the symbol * represents a convolution operation.

A gain β is calculated in accordance with the following equation (9):

$$\beta=\sum_{n=0}^{N-1}x'_w(n)y_w(n-T)\Big/\sum_{n=0}^{N-1}y_w^2(n-T) \tag{9}$$

Herein, in order to improve the accuracy in extracting the delay with respect to a female sound or a child voice, the delay may be obtained from a sample value having floating point, instead of a sample value consisting of integral numbers. The details of the technique are disclosed, for example, in P. Kroon et al, "Pitch predictors with high temporal resolution" (Proc. ICASSP, pp. 661–664, 1990: hereinafter referred to as Reference 11) and so on. Reference 11 is incorporated herein by reference.

Furthermore, the adaptive codebook circuit 500 carries out pitch prediction in accordance with the following equation (10) and delivers a prediction residual signal $e_w(n)$ to the excitation quantization circuit 350.

$$e_w(n)=x'_w(n)-\beta v(n-T)*h_w(n) \tag{10}$$

The excitation quantization circuit 350 is supplied with the utterance/silence judgment information from the mode judging circuit 800 and changes the pulses depending upon the utterance or the silence.

For the utterance, M pulses are produced.

As for the utterance, a polarity codebook or an amplitude codebook of B bits is provided for simultaneously quantizing pulse amplitudes for the M pulses. In the following, description will be made about the case where the polarity codebook is used.

The polarity codebook is stored in the excitation codebook 351 in case of the utterance and in the excitation codebook 352 in case of the silence.

For the utterance, the excitation quantization circuit 350 reads polarity code vectors out of the excitation codebook 351, assigns each code vector with a position, and selects a combination of the code vector and the position such that $D_k$ in the following equation (11) is minimized.

$$D_k=\sum_{n=0}^{N-1}\left[e_w(n)-\sum_{i=1}^{M}g'_{ik}h_w(n-m_i)\right]^2, \tag{11}$$

where $h_w(n)$ is a perceptual weighted impulse response.

To minimize the above equation (11) is achieved by finding a combination of the amplitude code vector k and a position $m_i$, the combination maximizing $D_{(k,I)}$ of the following equation (12):

$$D(k,i)=\left[\sum_{n=0}^{N-1}e_w(n)s_{wk}(m_i)\right]^2\Big/\sum_{n=0}^{N-1}s_{wk}^2(m_i) \tag{12}$$

Herein, $s_{wk}(m_i)$ is calculated by the second term in the summation at the right side of the equation (11), i.e., the summation of $g'_{ik}h_w(n-m_i)$.

Alternatively, $D_{(k,i)}$ expressed by the following equation (13) may be selected so as to be maximized. In this case, the amount of calculation of a numerator is decreased.

$$D_{(k,i)}=\left[\sum_{n=0}^{N-1}\phi(n)v_k(n)\right]^2\Big/\sum_{n=0}^{N-1}s_{wk}^2(m_i) \tag{13}$$

$$\phi(n)=\sum_{i=n}^{N-1}e_w(i)h_w(i-n),\quad n=0,\ldots,N-1 \tag{14}$$

It is noted here that, in order to reduce the amount of calculation, possible positions of the pulses in case of the utterance may be restricted as described in the above-mentioned Reference 3. By way of example, the possible positions of the pulses are given by Table 1, assuming N=40 and M=5.

TABLE 1

| | | | | | | | |
|---|---|---|---|---|---|---|---|
| 0, | 5, | 10, | 15, | 20, | 25, | 30, | 35, |
| 1, | 6, | 11, | 16, | 21, | 26, | 31, | 36, |
| 2, | 7, | 12, | 17, | 22, | 27, | 32, | 37, |
| 3, | 8, | 13, | 18, | 23, | 28, | 33, | 38, |
| 4, | 9, | 14, | 19, | 24, | 29, | 34, | 39, |

The excitation quantization circuit 350 delivers the index representative of the code vector to the multiplexer 400.

Furthermore, the excitation quantization circuit 350 quantizes the pulse position by a predetermined number of bits and delivers the index representative of the position to the multiplexer 400.

As for the silence, the pulse positions are determined at a predetermined interval as shown in Table 2 and shift amounts for shifting the positions of the pulses as a whole are determined. In the following example, if each shifting is carried out with one sample quantity, the excitation quantization circuit 350 can use four kinds of shift amounts (shift 0, shift 1, shift 2, shift 3). In this case, the excitation quantization circuit 350 quantizes the shift amounts into two bits and transmits the quantized shift amounts.

TABLE 2

| Pulse Position |
|---|
| 0, 4, 8, 12, 16, 20, 24, 28 . . . |

Furthermore, the excitation quantization circuit 350 is supplied with the polarity code vector from the polarity codebook 352 for each shift amount, searches combinations of every shift amounts and every code vectors, and selects the combination of the code vector $g_k$ and the shift amount δ(j) which minimizes the distortion $D_{k,j}$ expressed by the following equation (15).

$$D_{k,j} = \sum_{n=0}^{N-1}\left[e_w(n) - \sum_{i=1}^{M} g'_{ik} h_w(n - m_i - \delta(j))\right]^2 \tag{15}$$

The excitation quantization circuit 350 delivers to the multiplexer 400 the index indicative of the selected code vector and a code representative of the shift amount.

It is noted here that the codebook for quantizing the amplitudes of a plurality of pulses may be preliminarily obtained by learning from the speech signal and stored. The learning method of the codebook is disclosed, for example, in Linde et al, "An algorithm for vector quantization design" (IEEE Trans. Commun., pp. 84–95, January, 1980: hereinafter referred to as Reference 12). Reference 12 is incorporated herein by reference.

The amplitude/position information in case of the utterance or the silence is delivered to the gain quantization circuit 365.

The gain quantization circuit 365 is supplied with the amplitude/position information from the excitation quantization circuit 350 and with the utterance/silence judgment information from the mode judging circuit 800.

The gain quantization circuit 365 reads gain code vectors out of the gain codebook 380 and, with respect to the selected amplitude code vector or the selected polarity code vector and the position, selects the gain code vector so as to minimize $D_k$ expressed by the following equation (16).

Herein, description will be made about the case where the gain quantization circuit 365 carries out vector quantization simultaneously upon both of a gain of the adaptive codebook and a gain of an excitation expressed by pulses.

If the judgment information indicates the utterance, the gain quantization circuit 365 finds the gain code vector which makes $D_k$ expressed by the following equation (16) minimum.

$$D_k = \sum_{n=0}^{N-1}\left[x_w(n) - \beta'_i v(n-T) * h_w(n) - G'_i \sum_{i=1}^{M} g'_{ik} h_w(n - m_i)\right]^2 \tag{16}$$

Herein, $\beta_k$ and $G_k$ represent k-th code vectors in a two-dimensional gain codebook stored in the gain codebook 355. The gain quantization circuit 365 delivers the index indicative of the selected gain code vector to the multiplexer 400.

On the other hand, if the judgment information indicates the silence, the gain quantization circuit 365 searches the gain code vector so as to minimize $D_k$ expressed by the following equation (17).

$$D_k = \sum_{n=0}^{N-1}\left[x_w(n) - \beta'_i v(n-T) * h_w(n) - G'_i \sum_{i=1}^{M} g'_{ik} h_w(n - m_i - \delta(j))\right]^2 \tag{17}$$

The gain quantization circuit 365 delivers the index indicative of the selected code vector to the multiplexer 400.

The weighted signal calculating circuit 360 is supplied with the utterance/silence judgment information and each index and reads the code vector corresponding to the index. In case of the utterance, the weighted signal calculating circuit 360 calculates a drive excitation signal v(n) in accordance with the following equation (18).

$$v(n) = \beta'_i v(n-T) + G' \sum_{i=1}^{M} g'_{ik} \delta(n - m_i) \tag{18}$$

v(n) is delivered to the adaptive codebook circuit 500.

In case of the silence, the weighted signal calculating circuit 360 calculates a drive excitation signal v(n) in accordance with the following equation (19).

$$v(n) = \beta'_i v(n-T) + G' \sum_{i=1}^{M} g'_{ik} \delta(n - m_i - \delta(j)) \tag{19}$$

v(n) is delivered to the adaptive codebook circuit 500.

Next, by the use of the output parameter of the spectral parameter calculating circuit 200 and the output parameter of the spectral parameter quantization circuit 210, the weighted signal calculating circuit 360 calculates the response signal $s_w(n)$ for each subframe in accordance with the following equation (20) and delivers the response signal to the response signal calculating circuit 240.

$$s_w(n) = v(n) - \sum_{i=1}^{10} \alpha_i v(n-i) + \sum_{i=1}^{10} \alpha_i \gamma^i p(n-i) + \sum_{i=1}^{10} \alpha_i' \gamma^i s_w(n-i) \quad (20)$$

Figure 2:
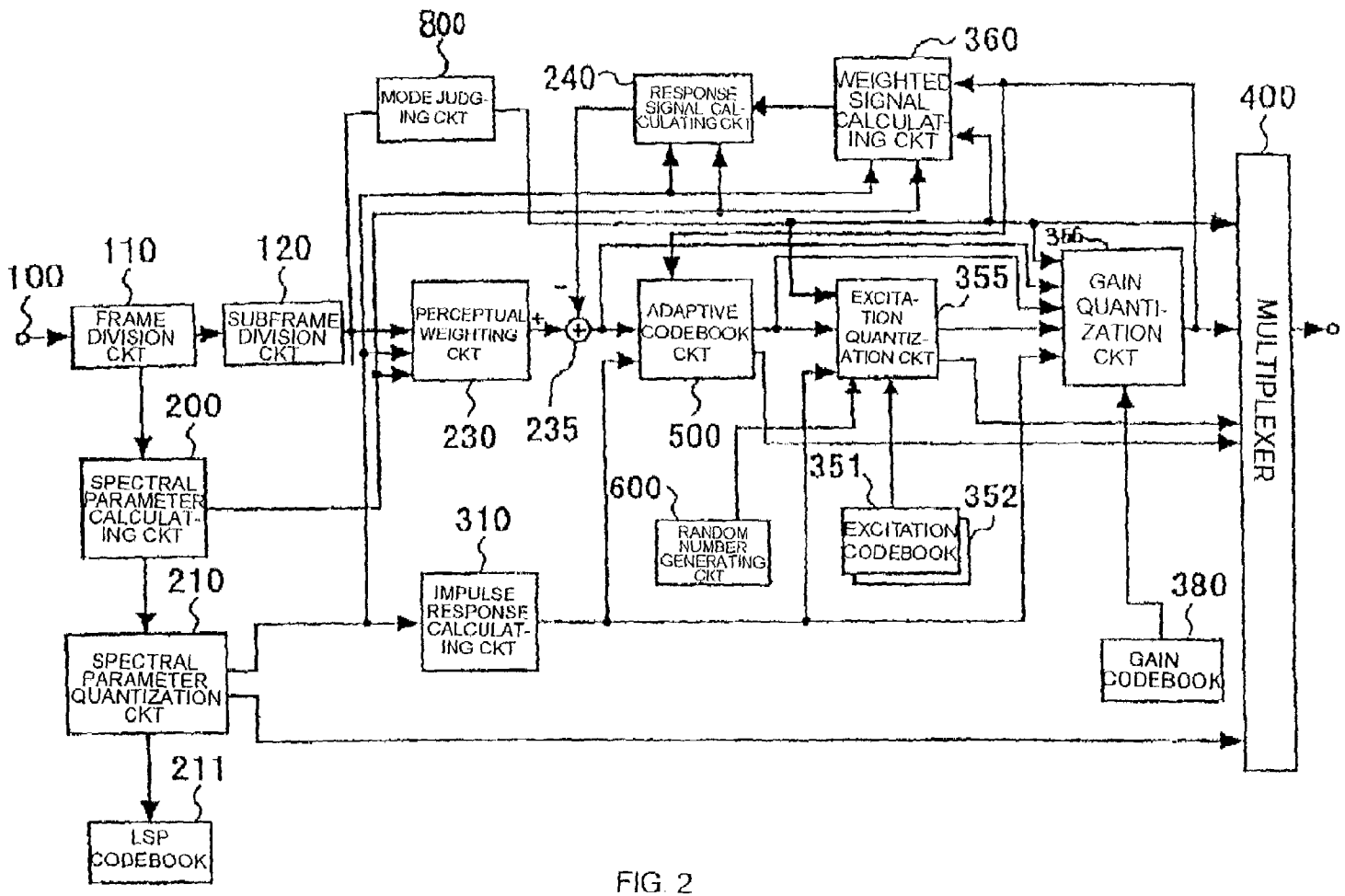
FIG. 2 is a block diagram showing the structure of a second embodiment of this invention.

Now, description will be made of a second embodiment of this invention. FIG. 2 is a block diagram showing the structure of the second embodiment of this invention.

Referring to FIG. 2, the second embodiment of this invention is different from the first embodiment mentioned above in the operation of an excitation quantization circuit 355. Specifically, in the second embodiment of this invention, positions generated in accordance with a predetermined rule are used as the pulse positions in case where the utterance/silence judgment information indicates the silence.

For example, a random number generating circuit 600 generates a predetermined number (for example, M1) of pulse positions. In other words, numerical values, M1 in number, generated by the random number generating circuit 600 is assumed to be the pulse positions. The positions, M1 in number, thus generated are delivered to the excitation quantization circuit 355.

The excitation quantization circuit 355 carries out the operation similar to that of the excitation quantization circuit 350 in FIG. 1 in case where the judgment information indicates the utterance and, in case of the silence, simultaneously quantizes the amplitudes or the polarities of the pulses by the use of the excitation codebook 352 for the positions generated by the random number generating circuit 600.

Figure 3:
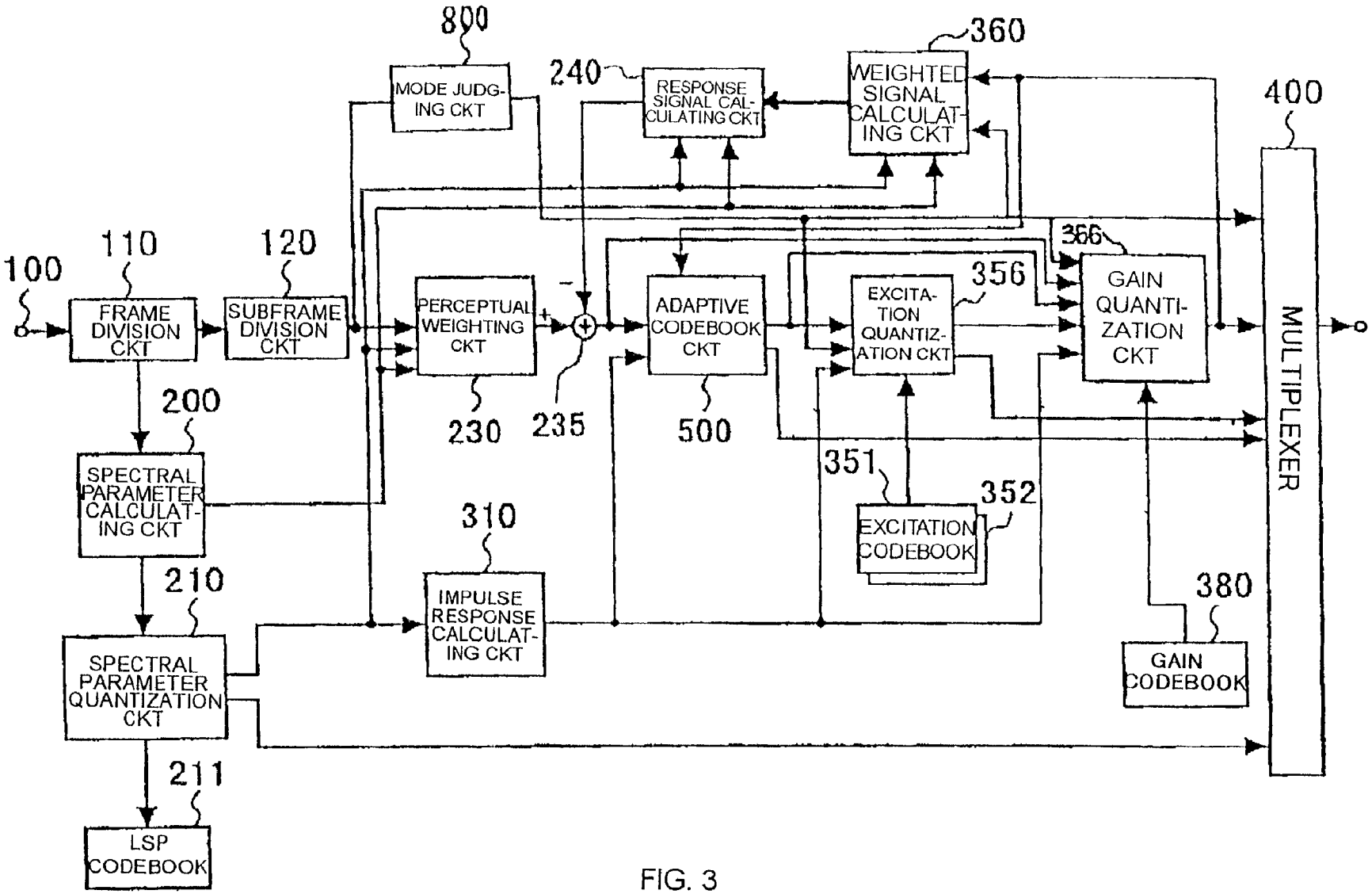
FIG. 3 is a block diagram showing the structure of a third embodiment of this invention.

Next, description will be made of a third embodiment of this invention. FIG. 3 is a block diagram showing the structure of the third embodiment of this invention.

Referring to FIG. 3, an excitation quantization circuit 356 calculates distortions according to the following equation for all combinations of every code vectors in the excitation codebook 352 and every shift amounts for the pulse positions, selects a plurality of combinations in the order of minimizing Dk,j expressed by the following equation (21), and delivers the selected ones to a gain quantization circuit 366, in case where the utterance/silence judgment information indicates the silence.

$$D_{k,j} = \sum_{n=0}^{N-1} \left[ e_w(n) - \sum_{i=1}^{M} g_{ik}' h_w(n - m_i - \delta(j)) \right]^2 \quad (21)$$

For each of a plurality of combinations of the outputs from the excitation quantization circuit 356, the gain quantization circuit 366 quantizes the gain by the use of the gain codebook 380 and selects a combination of the shift amount, the excitation code vector, and the gain code vector, the selected combination minimizing Dk,j of the following equation (22).

$$D_{k,j} = \sum_{n=0}^{N-1} \left[ x_w(n) - \beta_i' v(n-T) * h_w(n) - G' \sum_{i=1}^{M} g_{ik}' h_w(n - m_i - \delta(j)) \right]^2 \quad (22)$$

Figure 4:
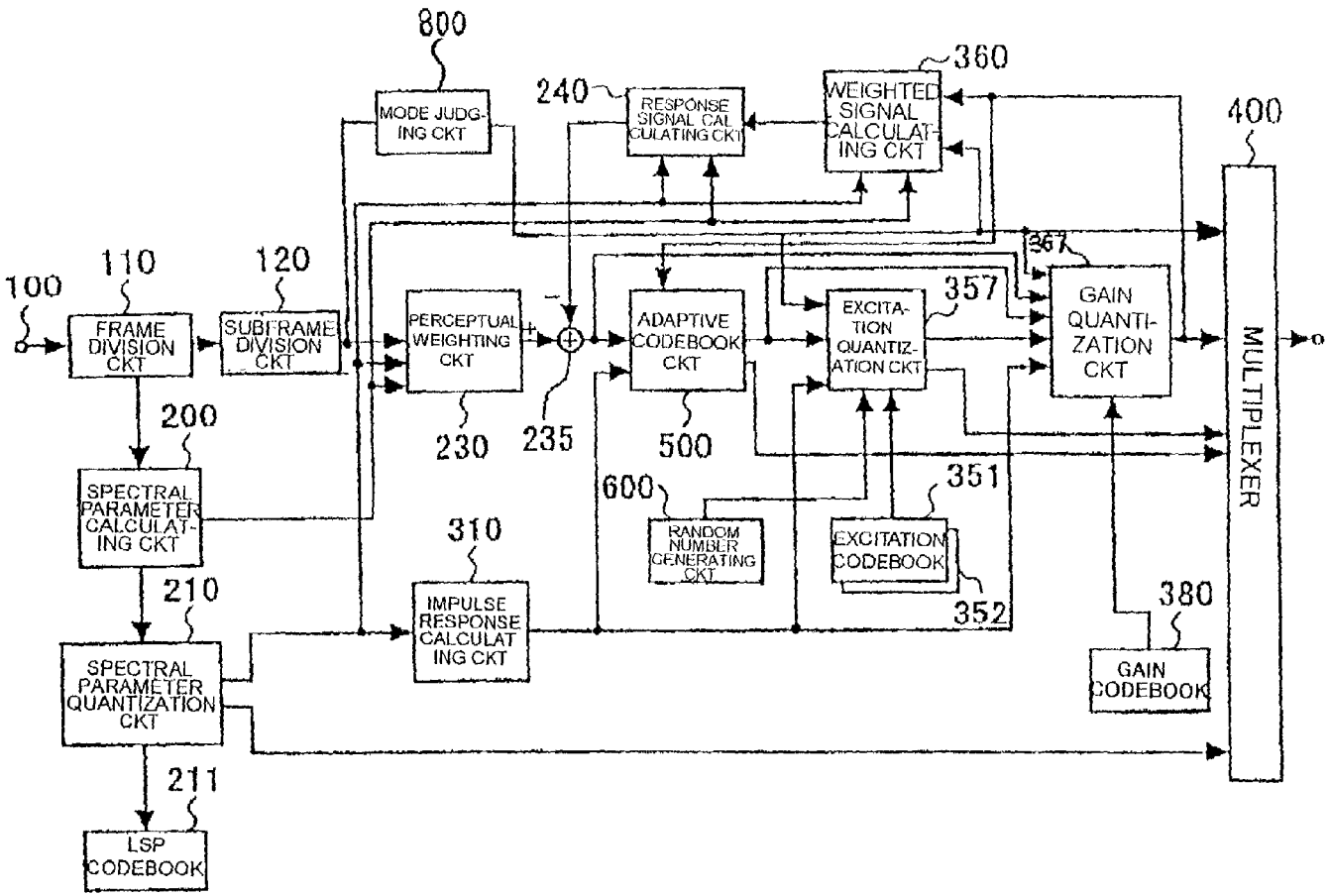
FIG. 4 is a block diagram showing the structure of a fourth embodiment of this invention.

Next, description will be made of a fourth embodiment of this invention. FIG. 4 is a block diagram showing the structure of the fourth embodiment of this invention.

Referring to FIG. 4, an excitation quantization circuit 357 simultaneously quantizes the amplitudes or the polarities of the pulses by the use of the excitation codebook 352 for the pulse positions generated by the random number generator 600, in case where the utterance/silence judgment information indicates the silence, and delivers all code vectors or a plurality of candidate code vectors to a gain quantization circuit 367.

The gain quantization circuit 367 quantizes the gain by the use of the gain codebook 380 for each of the candidates supplied from the excitation quantization circuit 357, and produces a combination of the gain code vector and the code vector which minimizes the distortion.

Figure 5:
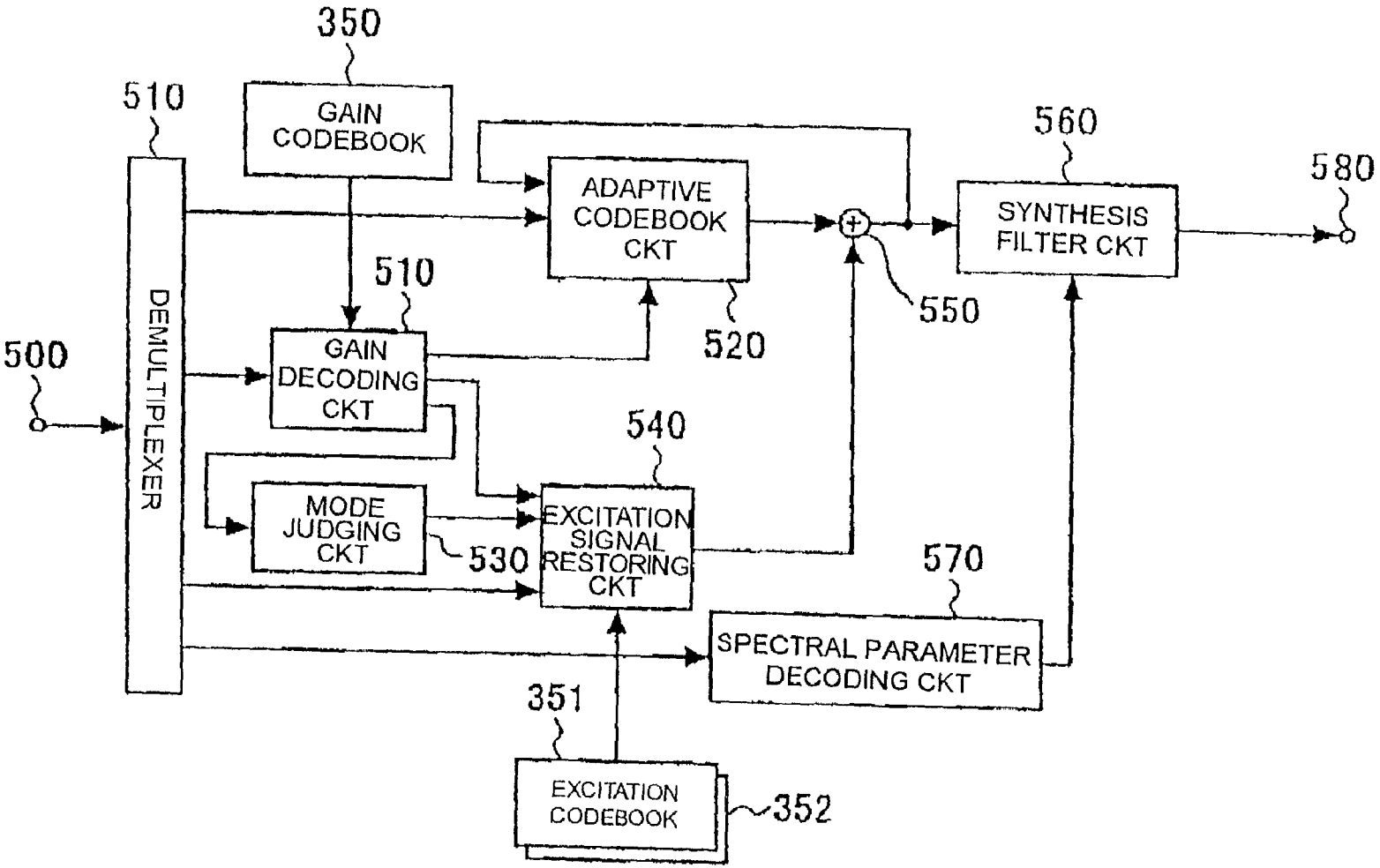
FIG. 5 is a block diagram showing the structure of a fifth embodiment of this invention.

Next, description will be made of a fifth embodiment of this invention. FIG. 5 is a block diagram showing the structure of the fifth embodiment of this invention.

Referring to FIG. 5, the demultiplexer 510 demultiplexes a code sequence supplied through an input terminal 500 into codes representative of spectral parameters, delays of an adaptive codebook, adaptive code vectors, gains of excitations, amplitude or polarity code vectors and pulse position, and outputs these codes.

Again decoding circuit 510 decodes the gain of the adaptive codebook and the gain of the excitation by the use of the gain codebook 380 and outputs decoded gains.

An adaptive codebook circuit 520 decodes the delay and the gain of the adaptive code vector and produces an adaptive codebook reproduction signal by the use of a synthesis filter input signal at a preceding subframe.

By the use of the adaptive codebook gain decoded with the preceding subframe, the mode judging circuit 530 compares the gain with a predetermined threshold value, judges whether or not a current subframe is the utterance or the silence, and delivers utterance/silence judgment information to the excitation signal restoration circuit 540.

Supplied with the utterance/silence judgment information, the excitation signal restoration circuit 540 decodes the pulse positions, reads the code vectors out of the excitation codebook 351, provides the amplitudes or the polarities thereto, and produces a predetermined number of pulses per subframe to restore an excitation signal, in case of the utterance.

On the other hand, in case of the silence, the excitation restoration circuit 540 generates pulses from the predetermined pulse positions, the shift amounts, and the amplitudes or the polarity code vectors to restore the excitation signal.

A spectral parameter decoding circuit 570 decodes the spectral parameters and delivers the spectral parameters to the synthesis filter circuit 560.

An adder 550 calculates the sum of the output signal of the adaptive codebook and the output signal of the excitation signal decoding circuit 540 and delivers the sum to the synthesis filter circuit 560.

The synthesis filter circuit 560 is supplied with the output of the adder 550 and reproduces a speech which is delivered through a terminal 580.

INDUSTRIAL APPLICABILITY

As described above, according to this invention, the mode is judged based on the preceding quantized gain in the adaptive codebook. In case of the predetermined mode, search is carried out for the combinations of every code vectors stored in the codebook for simultaneously quantizing the amplitudes or the polarities of a plurality of pulses and every shift amounts for temporally shifting the predetermined pulse positions to select a combination of the shift amount and the code vector which minimizes the distortion from the input speech. With this structure, the background noise part can be coded excellently with a relatively small amount of calculation, even if the bit rate is low.

According to this invention, search is carried out for the combinations of the code vectors, the shift amounts, and the gain code vectors stored in the gain codebook for quantizing the gains to select a combination of the code vector, the shift amount, and the gain code vector, the selected combination minimizing the distortion from the input speech. Thus, even if the speech with the background noise superposed thereon is coded at a low bit rate, the background noise part can be excellently coded.

What is claimed is:

1. A speech coder comprising:

a spectral parameter calculating unit supplied with a speech signal for calculating and quantizing spectral parameters;

an adaptive codebook unit for calculating a delay and a gain from a preceding quantized excitation signal by the use of an adaptive codebook, predicting the speech signal, and calculating a residue; and an excitation quantizing unit for quantizing an excitation signal of said speech signal by the use of said spectral parameters to produce an output;

said speech coder further comprising:

a judging unit for extracting a feature from said speech signal to judge a mode;

a codebook for representing the excitation signal by a combination of a plurality of nonzero pulses and simultaneously quantizing amplitudes or polarities of said pulses in case where the output of said judging unit is a predetermined mode;

said excitation quantizing unit for searching combinations of code vectors stored in said codebook and a plurality of shift amounts for shifting pulse positions of said pulses and producing as an output a combination of the code vector and the shift amount, the produced combination minimizing distortion from an input speech; and a multiplexer unit for producing a combination of the output of said spectral parameter calculating unit, the output of said judging unit, the output of said adaptive codebook unit, and the output of said excitation quantizing unit.

2. A speech coder comprising:

a spectral parameter calculating unit supplied with a speech signal for calculating and quantizing spectral parameters;

an adaptive codebook unit for calculating a delay and a gain from a preceding quantized excitation signal by the use of an adaptive codebook, predicting a speech signal, and calculating a residue; and an excitation quantizing unit for quantizing an excitation signal of said speech signal by the use of said spectral parameters to produce an output;

said speech coder comprising:

a judging unit for extracting a feature from said speech signal to judge a mode;

a codebook for representing the excitation signal by a combination of a plurality of nonzero pulses and simultaneously quantizing amplitudes or polarities of said pulses in case where the output of said judging unit is a predetermined mode and a gain codebook for quantizing the gain;

said excitation quantizing unit for searching combinations of code vectors stored in said codebook, a plurality of shift amounts for shifting pulse positions of said pulses, and gain code vectors stored in said gain codebook, and producing as an output a combination of the code vector, the shift amount, and the gain code vector, the produced combination minimizing distortion from an input speech; and a multiplexer unit for producing a combination of the output of said spectral parameter calculating unit, the output of said judging unit, the output of said adaptive codebook unit, and the output of said excitation quantizing unit.

3. A speech coder comprising:

spectral parameter calculating means supplied with a speech signal for calculating and quantizing spectral parameters;

adaptive codebook means for calculating a delay and a gain from a preceding quantized excitation signal by the use of an adaptive codebook, predicting a speech signal, and calculating a residue;

mode judging means for extracting a feature quantity from said speech signal and carrying out mode judgment as to the utterance or the silence and so on;

excitation quantizing means for quantizing an excitation signal of said speech signal by the use of said spectral parameters to produce an output, said excitation quantizing means searching, in case of a predetermined mode, combinations of code vectors stored in a codebook for simultaneously quantizing amplitudes or polarities of a plurality of pulses and a plurality of shift amounts for temporally shifting predetermined positions of the pulses and selecting a combination of the index of the code vector and the shift amount, the selected combination minimizing distortion from an input speech;

gain quantizing means for quantizing the gain by the use of a gain codebook; and multiplexer means for producing a combination of the outputs of said spectral parameter calculating means, said adaptive codebook means, said excitation quantizing means, and said gain quantizing means.

4. A speech coder as claimed in claim 3, wherein:

said excitation quantizing means uses, as the pulse positions, positions generated in accordance with a predetermined rule in case where judgment by said mode judging means indicated a predetermined mode.

5. A speech coder as claimed in claim 3, further comprising:

random number generating means for generating a predetermined number of pulse positions, said random number generating means delivering said positions thus generated to said excitation quantizing means in case where judgment by said mode judging means indicates a predetermined code.

6. A speech coder as claimed in claim 3, wherein:

said excitation quantizing means selects, from all combinations of every code vectors in said codebook and every shift amounts for the pulse positions, a plurality of combinations in the order of minimizing a predefined distortion and delivers the combinations to said gain quantizing means, in case where judgment in said mode judging means indicates a predetermined mode;

said gain quantizing means quantizing the gain by the use of said gain codebook for each of a plurality of sets of the outputs supplied from said excitation quantizing means and selecting a combination of the shift amount, the excitation code vector, and the gain code vector, the combination minimizing the predetermined distortion.

7. A speech coder as claimed in claim 3, wherein said mode judging means uses a pitch prediction gain as the feature quantity of said speech signal, compares the value of the pitch prediction gain calculated for each subframe and a predetermined threshold value, and judges the utterance and the silence when the pitch prediction gain is greater and smaller than said threshold value, respectively.

8. A speech coder as claimed in claim 3, wherein said predetermined mode is silence.

9. A speech coding/decoding apparatus including:

a speech coder comprising:

a spectral parameter calculating unit supplied with a speech signal for calculating and quantizing spectral parameters;

an adaptive codebook unit for calculating a delay and a gain from a preceding quantized excitation signal by the use of an adaptive codebook, predicting a speech signal, and calculating a residue;

an excitation quantizing unit for quantizing an excitation signal of said speech signal by the use of said spectral parameters to produce an output;

a judging unit for extracting a feature from said speech signal to judge a mode;

a codebook for representing the excitation signal by a combination of a plurality of nonzero pulses and simultaneously quantizing amplitudes or polarities of said pulses in case where the output of said judging unit is a predetermined mode;

said excitation quantizing unit for searching combinations of code vectors stored in said codebook and a plurality of shift amounts for shifting pulse positions of said pulses and producing as an output a combination of the code vector and the shift amount, the produced combination minimizing distortion from an input speech; and a multiplexer unit for producing a combination of the output of said spectral parameter calculating unit, the output of said judging unit, the output of said adaptive codebook unit, and the output of said excitation quantizing unit;

demultiplexer means supplied with a coded output of said speech coder for demultiplexing the coded output into codes representative of spectral parameters, delays of said adaptive codebook, adaptive code vectors, excitation gains, amplitudes or polarity code vectors as excitation information, and pulse positions and delivering these codes;

mode judging means for judging a mode by the use of a preceding quantized gain in an adaptive codebook;

excitation signal restoring means for generating, in case where the output of said mode judging means is a predetermined mode, pulse positions in accordance with a predefined rule, generating amplitudes or polarities of said pulses from the code vectors, and restoring an excitation signal; and a synthesis filter unit for passing said excitation signal to reproduce a speech signal.

* * * * *